US006363859B1

(12) United States Patent
Levi

(10) Patent No.: US 6,363,859 B1
(45) Date of Patent: Apr. 2, 2002

(54) AUTOMATIC CLAMPING DEVICE FOR CABLEWAY SYSTEMS OF THE TWO-CABLE TYPE

(75) Inventor: Ferruccio Levi, Cologno Monzese (IT)

(73) Assignee: Leitner S.p.A., Vipiteno (IT)

( * ) Notice: Subject to any disclaimer, the term of this patent is extended or adjusted under 35 U.S.C. 154(b) by 0 days.

(21) Appl. No.: 09/634,640

(22) Filed: Aug. 8, 2000

(30) Foreign Application Priority Data

Apr. 12, 2000 (IT) ..... MI00A0799

(51) Int. Cl.[7] ..... B61B 10/00
(52) U.S. Cl. ..... 104/173.1; 104/112
(58) Field of Search ..... 104/89, 118, 112, 104/115, 117, 173.1; 105/141, 148

(56) References Cited

U.S. PATENT DOCUMENTS 4,653,406 A 3/1987 Levi
4,686,906 A * 8/1987 Meindl ..... 104/209
4,957,047 A * 9/1990 Feuz et al. ..... 104/204
5,111,751 A * 5/1992 Zlotek ..... 104/209
5,582,109 A 12/1996 Levi et al.
5,595,122 A 1/1997 Levi et al.

* cited by examiner

*Primary Examiner*—S. Joseph Morano
*Assistant Examiner*—Robert J McCarry, Jr.
(74) *Attorney, Agent, or Firm*—Oblon, Spivak, McClelland, Maier & Neustadt, P.C.

(57) ABSTRACT

An automatic clamping device for cableway systems including a pair of jaws. One jaw of the pair of jaws is driven in opening and closing through at least one arm, which is capable of rotating around at least one articulated joint. The rotation occurs due to the action of springs or by operation from outside on an opening lever so as to grip or release a traction cable of a cableway system of the two-cable type.

13 Claims, 6 Drawing Sheets

AUTOMATIC CLAMPING DEVICE FOR CABLEWAY SYSTEMS OF THE TWO-CABLE TYPE

BACKGROUND OF THE INVENTION

1. Field of the Invention

The present invention relates to an automatic clamping device for cableway systems, in particular for two-cable systems.

2. Discussion of the Background

For some years it has been general practice to manufacture cableway systems of the single-cable type, wherein the only cable present on the system can be driven in translation by means of a winch, and it serves both as a carrying cable and as a traction cable of the vehicles, in particular cablecars, passing on the line.

Each telpher is supported upwards by a clamping vice of the cable, so that the vehicles can be supported and moved at the same time by the same cable.

Nevertheless, due to the mechanical stresses involved, the potentiality of the systems of this kind is limited to a relatively small number of passengers that every single vehicle can transport.

On the other hand, in a two-cable system the weight of the vehicle is not supported by the traction cable through the vice; on the contrary, besides the traction stresses, the vice also supports the stresses transmitted from the traction cable to the carrying cable and viceversa, which are due to the weight of the traction cable and to its deviation, in particular when passing on the line supports provided along the run, when the traction cable is lifted from the support rollers.

Those stresses can have relatively high values, and they are directed downwards.

Moreover, the stress transferred between the traction cable and carrying cable when passing on the line supports depends on the tension of the traction cable and on the entity of the lifting when passing on the rollers, and it easily reaches high values if the tension of the traction cable is considerable. As the tension cannot be reduced, it is indispensable to limit as much as possible the above lifting, and this implies particularly limiting geometrical bounds.

For the reasons mentioned above, also the provision of installing two vices, which must necessarily be mounted at the two sides of the suspension pin and at a considerable distance from it, for the purpose of not interfering with it, does not give any advantage, as it would imply lifting the cable from the rollers by an unacceptable entity.

Moreover, said arrangement would imply excessive overall dimensions of the structure.

SUMMARY OF THE INVENTION

Thus, object of the present invention is that of solving the technical disadvantages mentioned above, and in particular that of providing an automatic clamping device for cableway systems, which should exhibit particularly high clamping performances, with respect to the prior art, so as to allow the system to support high-capacity telphers, requiring at the same time a limited actuating force, as the opening lever arm is almost doubled with respect to the traditional devices currently used.

Another object of the present invention is that of providing an automatic clamping device for cableway systems, which should allow minimising the overall dimensions of the entire structure.

Last but not least, a further object of the present invention is that of providing an automatic clamping device for cableway systems, which should be particularly safe and reliable, and with relatively low price in virtue of the attained advantages.

These and other objects, according to the present invention, are attained by realising a novel automatic clamping device for cableway systems.

Advantageously, the presence of a single clamping device or vice according to the present invention, in a two-cable system, independently of the number of people transported by the telphers, allows limiting as much as possible the lifting of the cable when passing on the rollers; moreover, the open structure and the possibility of opening and closing the vice by directly operating on the mobile jaw, with consequent measure of the clamping moment directly onto said jaw, are qualifying technical features, above all from the point of view of the system safety.

Finally, it is necessary to install the jaw not too far from the suspension pin, but without interfering with it.

A peculiar feature of two-cable systems is that the jaw never comes into contact with the line rollers, since the traction cable is lifted by the jaw when passing on the rollers for the purpose of allowing transverse oscillations, which occur with respect to an axis arranged at the height of the traction cable: thus, side oscillations imply a transverse movement of the jaw with respect to the rollers, which would not be possible without a lifting; as a consequence, the shaping of the jaws is not bound by the configuration of the line rollers, and the jaws can exhibit the necessary stiffness without any space problems.

In addition, since the two-cable system with single carrying cable allows an easy rescue with a suspended system, which uses the traction cable as carrying cable for the rescue trolley, the jaws are configured so that they can be climbed over by said vehicle.

In conclusion, the vice is characterised by high technical performances; in fact, as the system must support 15–20 seat vehicles with a single vice, also giving up to climb high gradients, the vice must provide for a clamping in the range of about twice that provided by vices and systems of the same type currently in use.

On the other hand, advantageously, the driving force is in the same range of entity, as also the opening lever arm is almost doubled.

BRIEF DESCRIPTION OF THE DRAWINGS

Further features and advantages of a clamping device for cableway systems, according to the present invention, will appear more clearly from the following exemplifying and non-limiting description, made with reference to the attached schematic drawings. In such drawings.

DESCRIPTION OF THE PREFERRED EMBODIMENTS

Figure 1:
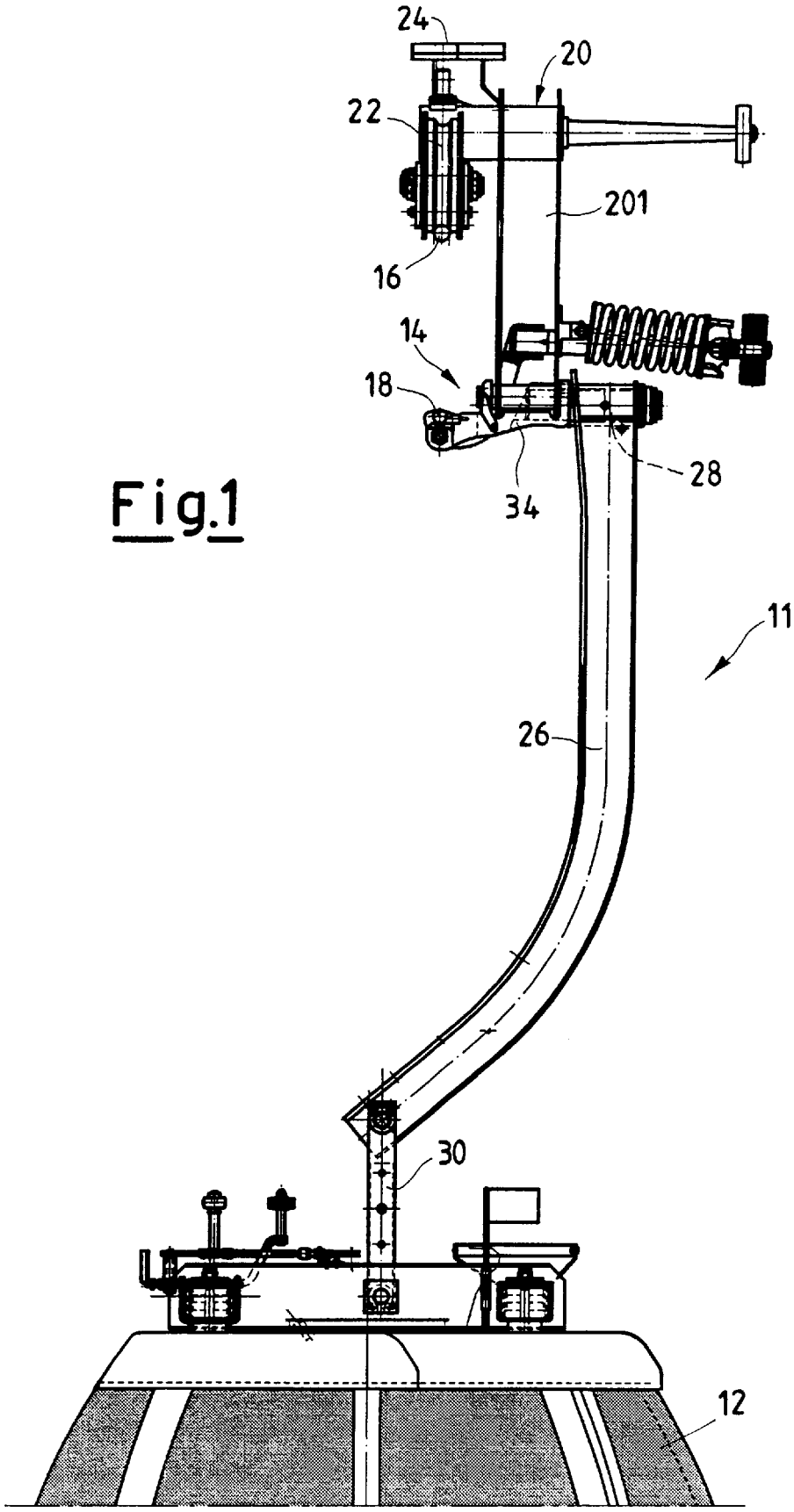
FIG. 1 shows a partial view in side elevation of a vehicle provided with an automatic clamping device, according to the present invention, and of the relevant cableway system.
Figure 2:
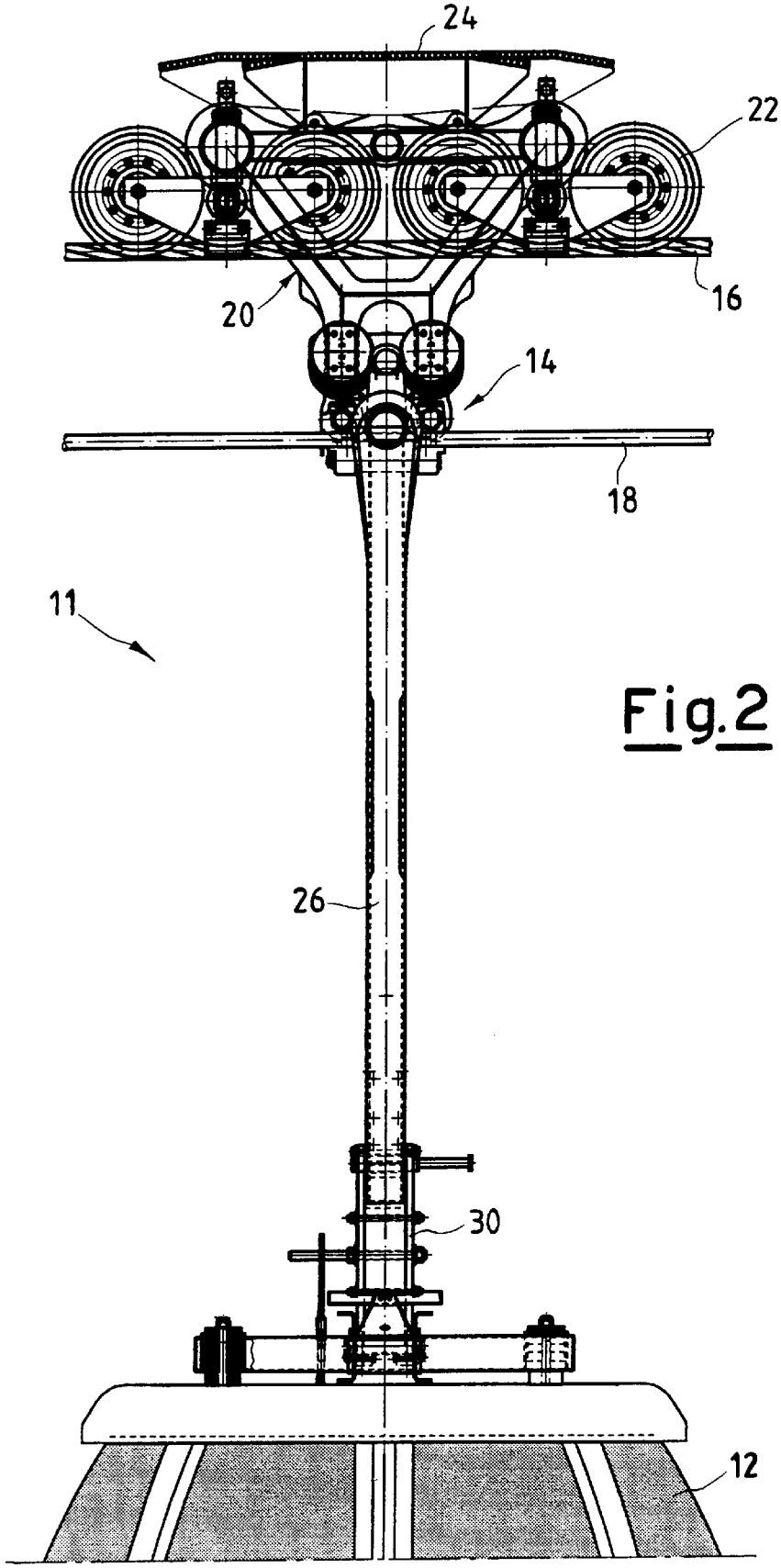
FIG. 2 shows a partial view in front elevation of the vehicle and of the system of FIG. 1.

With reference to FIGS. 1 and 2, there is partly shown a two-cable cableway system 11, provided with vehicles 12 which are equipped with an automatic clamping device 14, according to the present invention. The automatic clamping device 14 is shown in detail in FIGS. 3, 3A, 3B, 4 and 5.

System 11 comprises a carrying cable 16, fixed and supported by specially provided structures, known in se and not shown for convenience of representation.

System 11 also comprises a traction cable 18, arranged as much as possible vertically aligned with the carrying cable 16. The traction cable 18 can be made to translate by means of a winch, not shown.

Also the traction cable 18 is supported by specially provided structures, known in se and not shown. The carrying cable 16 supports vehicles 12, whereas the traction cable 18 drives them in translation. In fact, a trolley 20 is sliding on cable 16, realised with structural elements and made integral with one another, which supports four protruding aligned wheels 22, each of which is provided with a groove wherein the carrying cable 16 is housed.

On the upper side of trolley 20 there is a sliding block 24, which allows decelerating and stopping vehicles 12, or accelerating them up to a speed of synchronism with the speed of the traction cable 18. Sliding block 24 operates coupled with idle and/or motorised rollers, not shown, which are arranged at the stations in a known way.

Trolley 20 is connected to a support 201 of a suspension arm 26 of vehicle 12.

A pin 28 of suspension 26 is integral part of the clamping device according to the invention, and it exhibits an axis, which develops in orthogonal direction with respect to the motion direction, and whose prolongation is substantially arranged on the same line that intersects the axis of the traction cable 18.

In turn, the suspension arm 26 is articulated to a bar 30 integral with a roof portion of vehicle 12. Moreover, the trolley 20 carries the automatic clamping device or vice 14, according to the present invention, which is fastened at the lower end of trolley 20 by means of a pair of pins 32.

Vice 14 comprises a plate portion or bracket 34 from which, at a first end, two arms 36 extend, which carry jaws 44, 52, articulated with one another through the articulated joint 50.

At a second end, opposed to the first one, vice 14 exhibits a projecting square portion, which defines two side appendices or support wings 38, 42 connected through a central thicker portion 40; the above thicker portion 40 exhibits a through bore wherein, when device 14 is mounted, there is inserted a pin 28. In practice, the fixed jaw 44 is integral with pin 28 of suspension 26 and with the fixed articulation of springs 64, through a pair of wings also integral with the upper trolley 20.

Every arm 36 exhibits an appendix or wing 42 as well, which faces appendix or wing 38. The facing appendices 38, 42 exhibit an aligned through bore wherein pins 32 for fastening device 14 to trolley 20 are inserted.

Each end of arms 36 exhibits a square seat, where the fixed jaw 44 is fastened through screws, and which defines an aperture 46.

Inside aperture 46 there is inserted an arm 48, which is turnably fastened to an articulated joint 50 supported at the ends of arms 36.

One of the ends of arm 48 carries the mobile jaw 52, whereas one opposed end extends up to cover bracket 34, and it is fastened to a stem 54 at the terminal portion.

In practice, arm 48 connected to stem 54 and to jaw 52 defines an S-shaped structure adapted to pass under the fixed jaw 44 and on pin 28 of the suspension, without interfering (in total opening position) with some fixed station devices arranged above the same device or vice 14.

At a free end of stem 54 there is inserted a block 56, provided with a passing aperture 58 of considerable size with respect to the transverse size of stem 54, so that the latter can oscillate. Stem 54 and block 56 are pivoted with one another by means of a pin 60, blocked by means of a series of split pins.

Block 56 is integral with a stiffened bottom plate 62, also provided with a through bore aligned with the passing aperture 58 of block 56, inside which there is inserted stem 54.

Two springs 64 are arranged in abutment against opposed portions of bottom plate 62, whereas at the other side they are arranged against two plates 66.

Moreover, at a fixed joint 68, each plate 66 is pivoted to a support flange 70, which is fastened to trolley 20 by means of screws or bolts inserted into bores 72. Each spring 64 is wound around a guide stem 74, which has an end fastened to plate 66, whereas the opposed end is blocked by a nut 75 beyond bottom plate 62.

Moreover, on stem 54 there is inserted an auxiliary support safety pin 77 for block 56, at which block 56 exhibits a concave shaped edge portion, whereas the end portion of stem 54 carries a roller 78, mounted on bearings and blocked, in a known way, by means of a nut.

Figure 3:
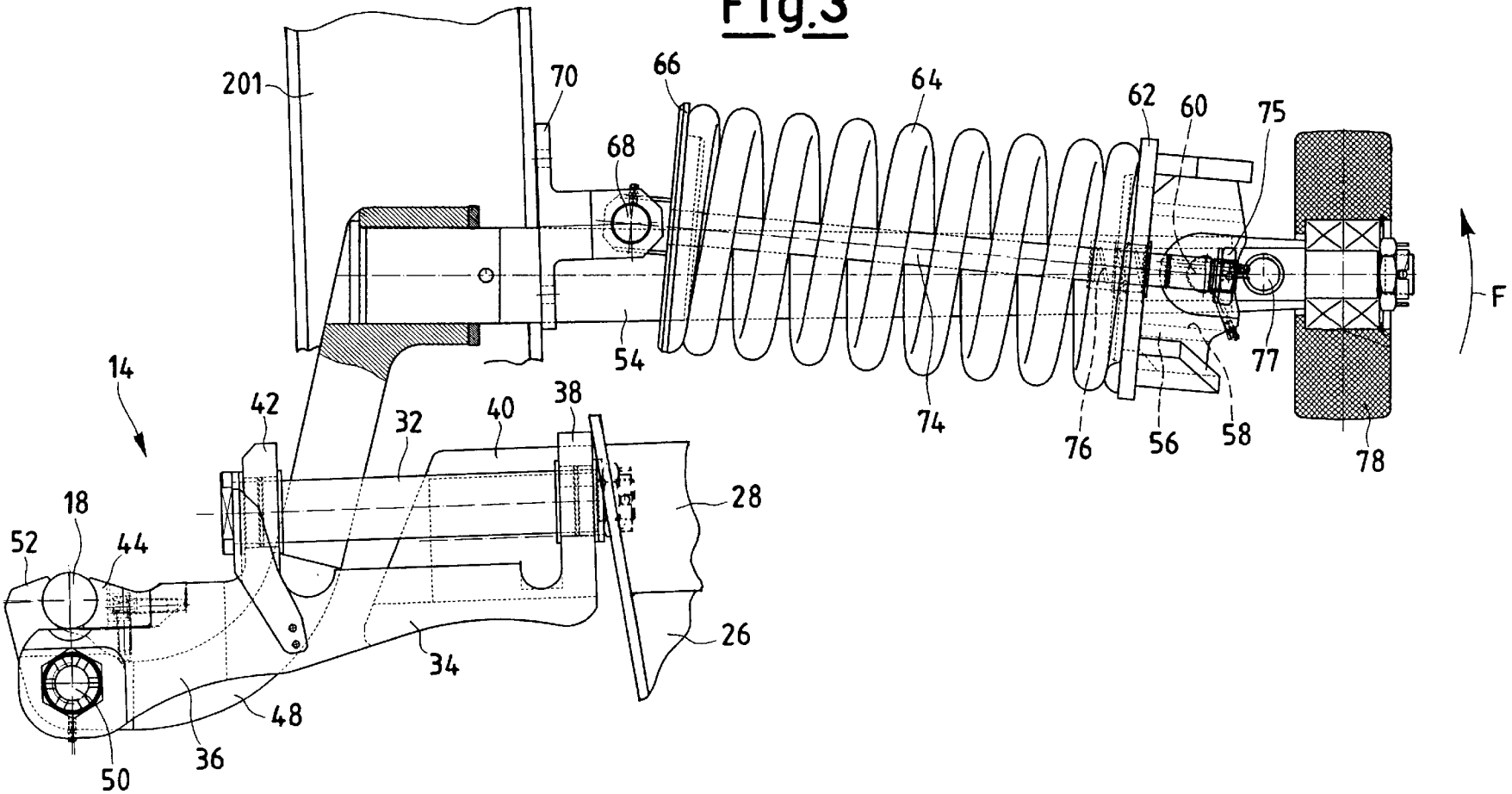
FIG. 3 shows a side elevation view of the automatic clamping device according to the present invention.
Figure 3B:
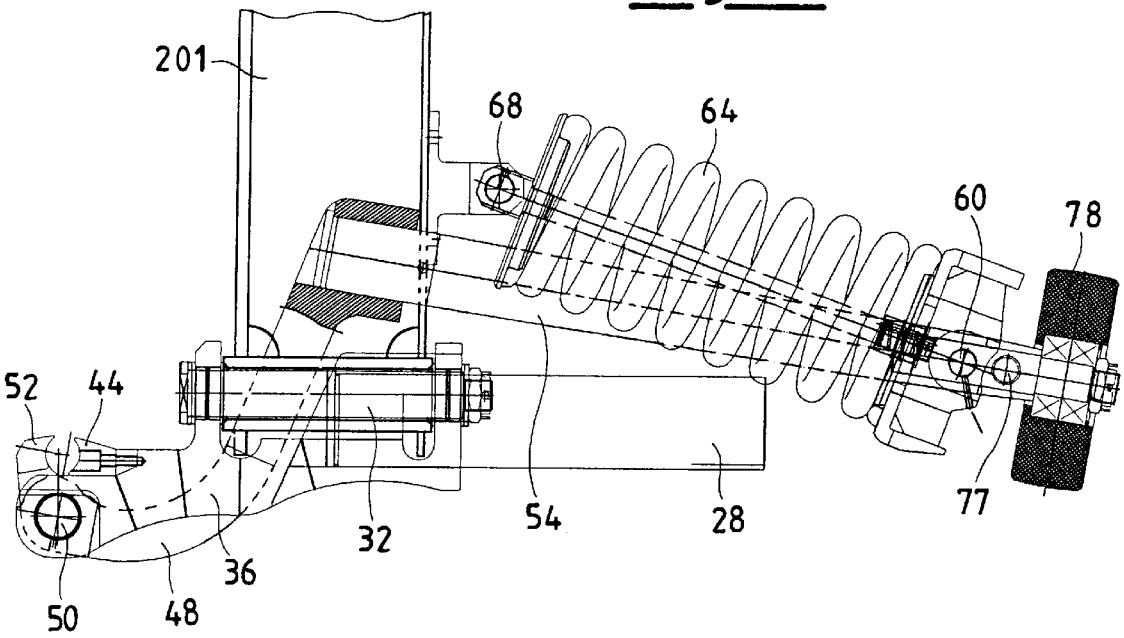
FIG. 3B shows a schematic view in side elevation of the automatic clamping device of FIG. 3, in a second operating position, that is to say, completely closed and without cable.
Figure 3A:
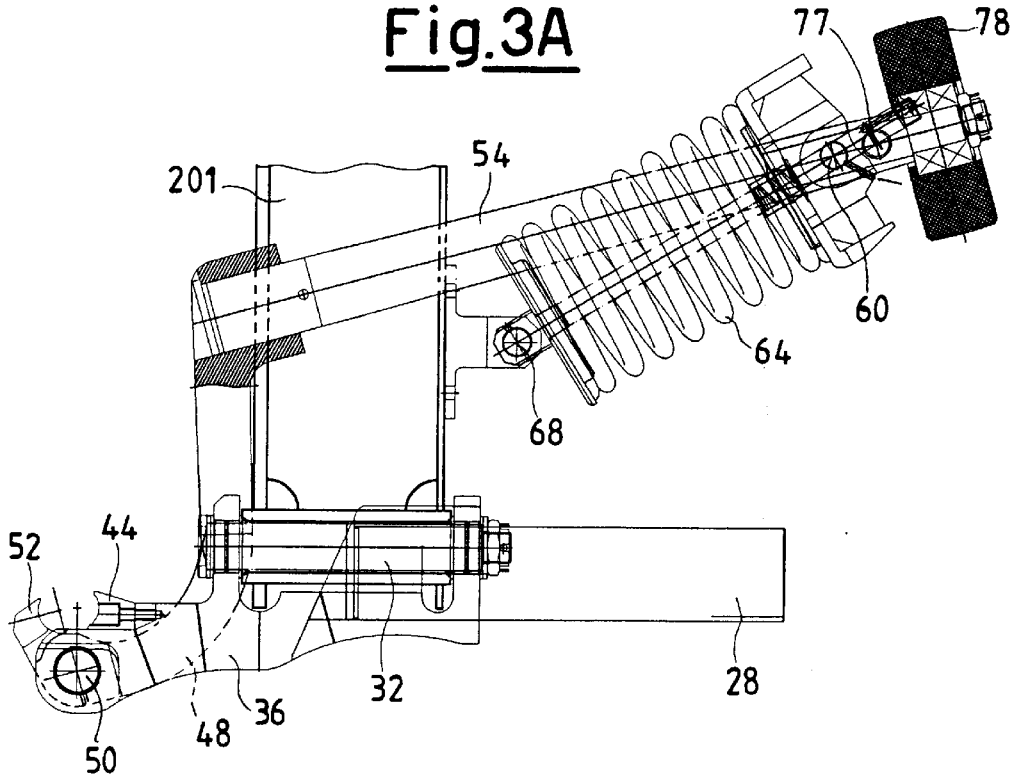
FIG. 3A shows a schematic view in side elevation of the automatic clamping device of FIG. 3, in a first operating position, that is to say, completely open on the cable.
Figure 4:
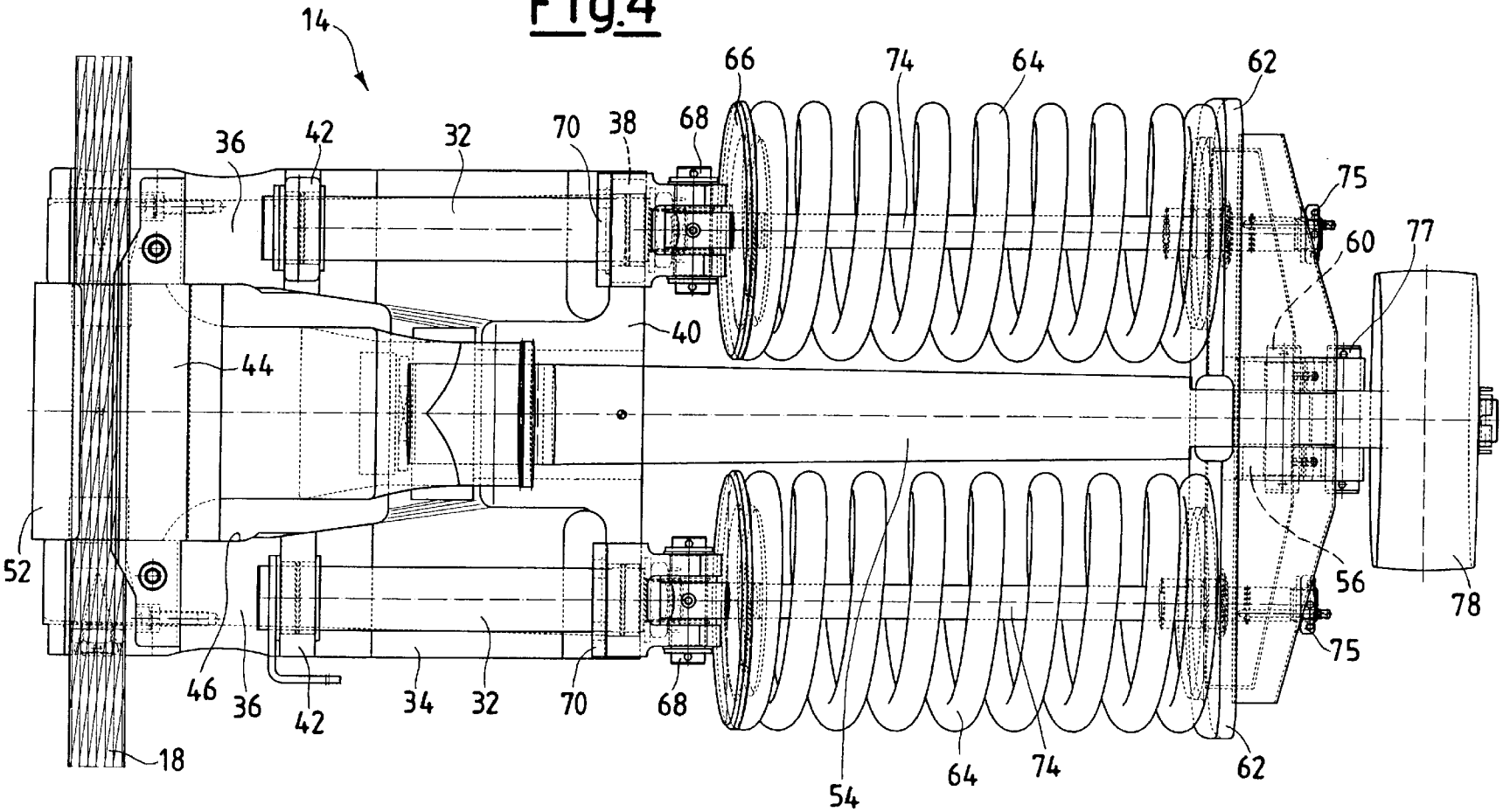
FIG. 4 shows a plan view of the automatic clamping device of FIG. 3.
Figure 5:
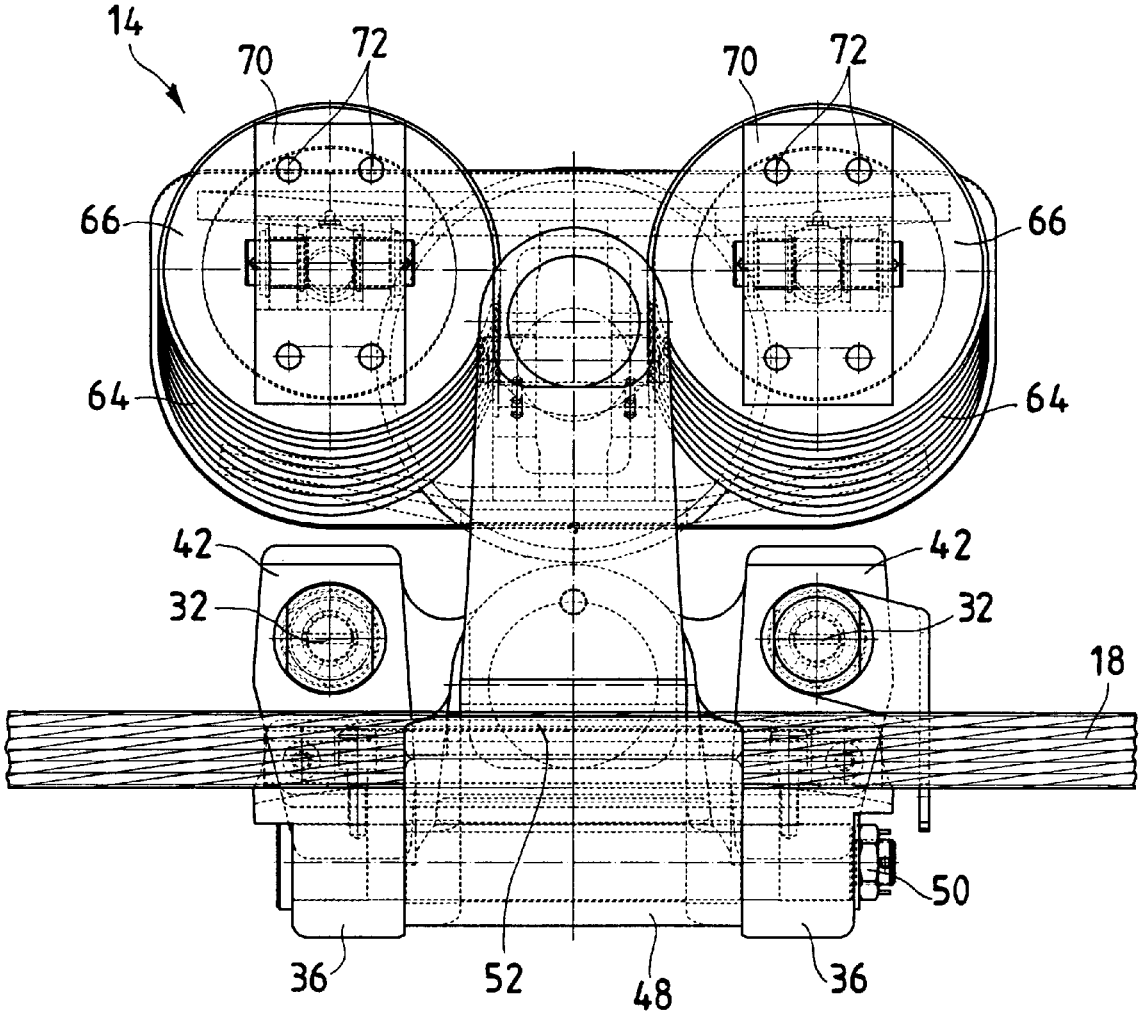
FIG. 5 shows a front elevation view of the automatic clamping device of FIG. 3.

As it is evident in particular in FIG. 3, the articulated joint 50 between jaws 44, 52 of vice 14 is provided at an opposed side with respect to stem 54 and to roller 78 connected to it, whereas the same jaws 44, 52 are arranged between the articulated joint 50 and stem 54.

In this way, jaw 52, hinged to arm 36, is reciprocally pivoted to jaw 44 in a portion of vice 14, which is turned downwards. Both jaws 44, 52, in operating position, are turned upwards.

The operation of the automatic clamping device or vice 14 for cableway systems 11, according to the invention, is substantially as follows.

Vice 14 is suspended and fastened to trolley 20, whereas the end of trolley 20 is inserted into the opening defined between bracket 34 and appendices or wings 38, 42, coupled and blocked by means of pins 32; similarly, flanges 70 are fastened to trolley 20 by means of screws or bolts 72.

Moreover, pin 28 of suspension 26, which realises the joint of the suspension arm 26 to trolley 20, is inserted into the through bore of the thicker portion 40 of device 14.

In operation, vice 14 can take two different operating configurations: in a first configuration, shown in FIG. 3, vice 14 is closed and it grips the traction cable 18.

In this configuration, springs 64 press on bottom plate 62 and the latter, through block 56 and pin 60, exerts a force onto stem 54 that actuates the mobile jaw 52, with respect to the fixed jaw 44, so as to clamp cable 18.

The force of springs 64 directly transmits between fixed jaw 44 and mobile jaw 52 which, for construction reasons, is divided into two rigidly integral parts; the nominal clamping stress is simply the product of the stress of the springs by the ratio of arms 36, 48 with respect to the articulated joint 50 between jaws 44, 52.

In case of variation of the diameter of cable 18 with respect to the nominal value, the points arranged at the articulated joint 50 and at the fixed joint 68 remain fixed, whereas pin 60 moves; the kinematic mechanism is such that the variation in the length of spring 64 corresponds to such a variation of the arm as to keep the stress multiplied by the arm sensibly constant for a wide range of the actual diameter of cable 18. In this way, a sufficient clamping is always ensured without an oversizing of springs 64 and the organs connected to them being needed.

The further free stroke of the kinematic mechanism in the closing direction of jaws 44, 52 is guaranteed by the stroke still available on the guide stem 74 before abuting against the stop arranged onto bottom plate 62; moreover, the latter is provided in such position as to intervene before having the mobile jaw 52 in its closing movement interfere with any fixed component.

The opening of jaw 52 occurs by operating through a station guide onto roller 78; actually, at each station of the cableway system 11, vice 14 is opened, so that the traction cable 18 can slide with respect to jaws 44, 52 thanks to the action of a guide (not shown in the figures) which is coupled with roller 78.

Due to the feature of the kinematic mechanism, the force to be applied onto roller 78, which is directed upwards, is at first slightly increasing due to the compression of springs 64; once a certain maximum has been reached, it starts to decrease since there is the prevalence of the effect of the decrease of the angle having vertex in 60 and as sides, the segments respectively connecting joints 50, 60 and 60, 68.

If the kinematic mechanism is such as to never reach the dead centre or toggle point, preferable condition for operation, but not for this reason being a limit for the objects of the invention, the force of roller 78 always stays definitely positive.

This law of force variation represents the optimum solution as regards the dynamic stresses when entering into the station, the passengers' comfort and the wear of mechanical gears; in fact, also the total work needed for opening the articulated joint 50 is optimised.

As a consequence of the guide-roller coupling, stem 54 rotates about the articulated joint 50, according to the direction defined by arrow F, whereas bottom plate 62 slides along stems 54, remaining aligned with them, and it oscillates with respect to pins 68. The rotation of stem 54 also causes the rotation of stems 74, whereas bottom plate 62 compresses spring 64 so that the mobile jaw 52 opens with respect to the fixed jaw 44.

The vertical force applied to the opening roller 78 is opposed by the weight of vehicle 12; thus, it reduces the vertical reaction of wheels 22 of trolley 20 on the station rail; the horizontal and unbalancing components are opposed by the station guide system, the position of which can change from system to system.

At the end of the opening, after cable 18 has certainly exited from jaws 44, 52, the station guide returns downwards thus allowing the articulated joint 50 to gradually close vice 14 under the thrust of springs 64. Then, the articulated joint 50 passes through the station in rest condition, with springs 64 at the end of stroke bearing against the stop onto bottom plate 62, and thus, without stress in the kinematic mechanism.

During the exit from a station 11 of the installation, when a guide lowers stem 54, springs 64 contribute to closing vice 14 and guarantee afterwards a significant clamping force.

In practice, the opening and/or closing of device 14 is directly operated on the stem 54, directly connected to the mobile jaw 52. The direct manoeuvre always guarantees the forced opening of the vice, independently of any failure of the kinematic mechanism, thus meeting an essential safety requirement.

The configuration of vice 14 just described allows bearing all the stresses exchanged between traction cable 18 and carrying cable 16, and due to the weight of the traction cable 18 and to its deflection, in particular when passing on the line supports when the traction cable 18 is lifted from the support rollers 78.

Said stresses can have a relatively high value, and they are directed downwards; thus, it is indispensable to install vice 14 upside down, with respect to the jaws being used, making the traction cable 18 enter from above.

Moreover, in this way, the shaping of jaws 44, 52 is not bound by the configuration of the line rollers 78, and thus arms 36, 48 of the above jaws 44, 52 can be manufactured with the same stiffness without problems of space.

Finally, it is necessary to have the particular described configuration of arms 36, 48, so that the same can be climbed over by a rescue vehicle, since the two-cable system with single carrying cable allows a quite easy rescue with a suspended system, which uses the traction cable 16 as carrying cable for a rescue trolley.

The presence of a single vice 14 for each vehicle 12 of system 11, the open structure of the kinematic mechanism, the possibility of opening and closing vice 14 by directly operating onto said mobile jaw 52 and the possibility of measuring the clamping momentum directly onto said mobile jaw 52, are all fundamental and qualifying features for the safety of the entire clamping device.

As seen above, insuperable geometrical bounds force to reverse the operation of vice 14, applying an opening from the bottom; for this reason, although the opening force is always smaller than the weight of the empty vehicle 12, the cableway system 11 comprises a system of guides to prevent any lifting of vehicle 12 during the operation of vice 14.

The choice of the clamping kinematic mechanism of vice 14 is made by taking into account the need of guaranteeing the line parking, with exposure to severe weather conditions, and in particular to snow and to ice encrustations.

Thus, the kinematic mechanism exhibits the following features: great structural simplicity, with a limited number of parts and thus, a limited number of couplings in relative motion with one another; immediate accessibility to the interior, thanks to the open-type structure, so as to permit an immediate accessibility and prevent drifting snow or ice into cavity from which it is difficult to remove them; facilitation in removing any drifting snow from the couplings, preventing its compaction.

In practice, the elastic system of vice 14 according to the invention comprises two parallel long-stroke helical springs 64, so as to easily break any possible ice film for torsional deformation; the two springs 64 are completely separate and not coaxial, so as to easily allow the passage of the snow through the turns, whereas the assembly is carried out so that, should a spring 64 be missing, this would not impair the efficiency of the other one.

Moreover, the long stroke of springs 64 (more than 120 mm) allows a relative insensibility to the small unevenness of the kinematic mechanism due to the machining tolerance of the pieces and to the bedding tolerance of the same vice 14.

Finally, the kinematic mechanism is of the direct type, meaning that the load of the springs directly operates between the fixed jaw 44 and the mobile jaw 52, without interposition of connecting rods, cams or leverages, and it does not have dead centre, and thus the articulated joint 50 exhibits a single rest configuration, in close position; in this way, sudden changes of direction of the opening and closing stresses are prevented, with less dynamic stresses and better comfort for the transported passengers. Even the opening of vice 14 occurs directly onto roller 78, integral with the mobile jaw 52.

In a more general case, it would be convenient to have the kinematic mechanism of the clamping device according to the invention reach and exceed the dead centre; in case of overcoming of the dead centre, it must be noted that the opening force of the device is not directed upwards anymore, and the same device spontaneously returns to the close position.

In practice, the particular geometrical configuration of vice 14 derives from the need of minimising the lifting of the cable when passing on the line rollers for the purpose of minimising the stresses exchanged between the traction cable and the carrying cable through the vehicles, and from the need of keeping the height of the articulation pin 28 as close as possible to that of cable 18.

Vice 14 includes the following constructive provisions to prevent the possibility of a failed detachment from cable 18 at the entrance to the station: the opening force is directly applied to the mobile jaw 52 through roller 78, and the movement of jaw 52 is thus directly forced by the geometrical shape of the station cam. Moreover, also in case of failure of jaw 52 in the portion between roller 78 and the fixed joint 68 of spring 64, the opening cam is still capable of opening jaw 52 by operating, in this case, through direct sliding on the outer support plate 66 of springs 64, the configuration of which is especially designed for this purpose.

From the above description, the features of the automatic clamping device for cableway systems, which is object of the present invention, as well as its advantages, are evident. In particular, they are attained thanks to the following technical features:

opening and closing of the articulated joint between the jaws directly practicable through an action onto a prolongation of the mobile jaw, without the interposition of any cam, articulated joint or leverage;

sensibly vertical and directed upwards force needed for inducing the movement of the jaw, the above stress being sensibly constant for a wide movement astride of the normal closing position.

It is clear that several modifications can be made to the automatic clamping device in object without departing from the novelty principles of the inventive idea, and it is also clear that, in the practical implementation of the invention, materials, shapes and sizes of the illustrated details can be of any type according to the requirements, and the same can be replaced with others, technically equivalent.

What is claimed is:

1. An automatic clamping device for a two-cable cableway system, including a traction cable and a carrying cable, comprising:

a pair of jaws, at least one jaw of the pairs of jaws configured to be driven in opening and closing operations by at least one arm configured to rotate about at least one articulated joint from action of elastic means for catching and releasing at least one cable of the two-cable cableway system; and a first structure configured to carry a first jaw of the pair of jaws that is fixed and is directly connected to at least one fastening element of a suspension arm of at least one vehicle of said cableway system, wherein said first structure is fixed with respect to a pivoting of said elastic means and is integral, through at least one appendix or support wing, to a dragging trolley of said vehicle, whereas a second jaw of the pair of jaws is mobile and is articulated with said fixed jaw through said articulated joint, said opening and closing operations being actuated by directly operating on said second mobile jaw.

2. An automatic clamping device according to claim 1, wherein said second mobile jaw is supported by a second structure divided in two rigidly integral parts defining an S shape, so that said second structure is configured to pass under said fixed jaw and on said fastening element without interfering with a fixed station device arranged above said device.

3. An automatic clamping device according to claim 1, wherein said opening operation of the pair of jaws at said articulated joint directly occurs on at least one roller integral with said second mobile jaw.

4. An automatic clamping device according to claim 1, wherein said at least one fastening element of the suspension arm is substantially arranged at a same vertical height as the traction cable.

5. An automatic clamping device according to claim 1, wherein the clamping device is substantially installed in a vicinity of said fastening element of the suspension arm of the vehicle, without interfering with said suspension arm.

6. An automatic clamping device according to claim 1, wherein said elastic means comprises two parallel long-stroke helical springs, said springs being separate and not coaxial, and comprising at least one guide stem, at least one bottom plate, and, at an opposed side of said bottom plate, a further abutment or plate integral with said pivoting of the elastic means.

7. An automatic clamping device according to claim 1, wherein a load of said elastic means directly operates between said first and second jaw.

8. An automatic clamping device according to claim 1, wherein the traction cable is clamped by said second mobile jaw, said first and second jaws being turned upwards, and said opening operation occurs starting from a height arranged underneath said elastic means.

9. An automatic clamping device according to claim 8, wherein the pair of jaws and first structure form a kinematic mechanism without a dead center, and wherein said articulated joint exhibits a single rest configuration, in a closing position of the pair of jaws.

10. An automatic clamping device according to claim 9, wherein in said kinematic mechanism, a variation in a length of said elastic means corresponds to a variation of the arms of transmitted forces, so as to keep a product between a stress of said elastic means by a ratio of said arms sensibly constant, with respect to the articulated joint of said jaws for a wide range of measures relating to diameters of the traction cable.

11. An automatic clamping device according to claim 1, wherein said opening operation occurs by operating through a station guide on at least one roller.

12. An automatic clamping device according to claim 6, wherein, the pair of jaws and first structure form a kinematic mechanism, and should said kinematic mechanism be not provided with a dead center, at an end of the opening operation, after said traction cable has exited from said jaws, said station guide returns towards a height arranged underneath the clamping device, thus allowing said articulated joint to gradually close said device under thrust of the springs, said articulated joint entering into a rest condition during a run of said vehicle at each station of said cableway system, with the springs in position of an end of stroke against said bottom plate.

13. An automatic clamping device according to claim 6, wherein the pair of jaws and first structure form a kinematic mechanism, and should said kinematic mechanism exceed a dead center and should at least one external force be needed for reaching the dead center, at an end of the opening operation, after the traction cable has exited from said jaws, said station guide returns towards a height arranged underneath the clamping device, thereby allowing said articulated joint to gradually close said device under thrust of the springs, said articulated joint entering into a rest condition during a run of said vehicle at each station of said cableway system, with the springs in position of an end of stroke against said bottom plate, said springs completing the closing of said articulated joint once the dead center has been exceeded.

* * * * *

UNITED STATES PATENT AND TRADEMARK OFFICE

CERTIFICATE OF CORRECTION

PATENT NO. : 6,363,859 B1
DATED : April 2, 2002
INVENTOR(S) : Levi

It is certified that error appears in the above-identified patent and that said Letters Patent is hereby corrected as shown below:

Title page,
Item [30], Foreign Application is incorrect. Item [30] should read as follows:
-- [30] Foreign Application Priority Data
Apr. 12, 2000 (IT) ---------- MI2000A000799 --

Signed and Sealed this

Twenty-fourth Day of September, 2002

*Attest:*

*Attesting Officer*

JAMES E. ROGAN
*Director of the United States Patent and Trademark Office*